United States Patent [19]

Nagashima et al.

[11] 4,444,875

[45] Apr. 24, 1984

[54] LIGHT-SENSITIVE SILVER HALIDE PHOTOGRAPHIC MATERIAL

[75] Inventors: Toshiharu Nagashima; Takeshi Habu, both of Hino, Japan

[73] Assignee: Konishiroku Photo Industry Co., Ltd., Tokyo, Japan

[21] Appl. No.: 478,902

[22] Filed: Mar. 25, 1983

[30] Foreign Application Priority Data

Apr. 5, 1982 [JP] Japan ..... 57-56838

[51] Int. Cl.[3] ..... G03C 5/24; G03C 1/06

[52] U.S. Cl. ..... 430/445; 430/264; 430/446; 430/600; 430/613; 430/949

[58] Field of Search ..... 430/600, 613, 949, 445, 430/446, 264, 267

[56] References Cited

U.S. PATENT DOCUMENTS 4,175,966 11/1979 Fujiwhara et al. ..... 430/598

4,210,715 7/1980 Fujiwhara et al. ..... 430/949

*Primary Examiner*—Mary F. Downey

*Attorney, Agent, or Firm*—Frishauf, Holtz, Goodman & Woodward

[57] ABSTRACT

Herein are disclosed a light-sensitive silver halide photographic material comprising a support and, coated thereon, a hydrophilic colloid layer or layers including a silver halide emulsion layer, at least one of said hydrophilic colloid layer or layers containing a 1H-tetrazolium compound, and an image-forming method which comprises processing a light-sensitive silver halide photographic material mentioned above.

The light-sensitive silver halide photographic material and the image-forming method according to the present invention can provide a high contrast silver image and a clear dot quality.

19 Claims, No Drawings

LIGHT-SENSITIVE SILVER HALIDE PHOTOGRAPHIC MATERIAL

This invention relates to a light-sensitive silver halide photographic material which can provide stably a high contrast photographic image, and a method for forming an image.

Generally, there have been employed letters or dot-formed photographic images in photomechanical process and high contrast photographic images for forming fine line image in ultrafine photomechanical process. It has been known that an extremely high contrast photographic image can be formed with certain silver halide photographic materials therefor.

There has been hitherto proposed, for instance, a method of the formation of an image having a high contrast, a high sharpness and a high resolving power, e.g. dot image or fine line image by processing a photosensitive material, which comprises a silver chlorobromide emulsion having an average grain size of 0.2 $\mu$, a narrow grain distribution, a uniform shape of grains and a high silver chloride content (at least 50 molar % or higher), with an alkaline hydroquinone developing solution having a low sulfite ion concentration.

This type of a silver halide photographic material is known as a lith-type photographic material.

Photomechanical process involves a step of converting a continuous tone original copy to a dot image, namely a step wherein change in continuous tone density of an original copy is converted to assembled dots having an area proportional to said density.

Then, an original copy is taken through a cross line screen or a contact screen by the use of the said lith-type photographic material and thereafter developed to form dot image.

For this purpose, one may use a silver halide photographic material which contains a silver halide emulsion of fine grains and uniform grain size and grain shape. However, even when such a silver halide photographic material is employed, a medium density region is also reproduced, in addition to the maximum density region and the minimum density region (fog) required for the formation of dot image, by processing with a developing solution for general type black-and-white photography and this medium density region tends to form undesirable density gradient portion, i.e. fringe, for processing, which leads to poor dot performance.

The lith-type photosensitive material has been previously employed for the reproduction of line image or fine line image, but when a developing solution for general type black-and-white photography was employed, $\gamma$ value in characteristic curve was at the best 5–6 and satisfactory characteristics (7–9 in terms of $\gamma$) for line image could not be provided on similar grounds.

In order to avoid such problems, a special developing solution as mentioned above has been utilized and is referred to as an infectious developing solution or a lith-type developing solution.

The infectious developing solution or lith-type developing solution as used herein is meant to indicate the developing solution containing substantially hydroquinone solely as a developing agent and having a low sulfite ion concentration, as discussed in detail by J. A. C. Yule in J. Franklin Inst., 239, 221 (1945).

Usually, continuous photomechanical process is carried out by means of an automatic developing machine or an automatic processing machine in photomechanical processing step and hence a large volume of a developing solution is used. However, a lith-type developing solution may be readily subjected to automatic oxidation to produce an extremely poor preservability. Therefore, there has been a large demand for a control system to keep development quality constant even during a continuous use, and considerable effort has been made to improve this preservability of a developing solution.

As one improvement process, there has been usually and widely utilized in an automatic developing machine for mechanical process and the like the so-called two liquid separate replenishing system wherein a replenishing solution for compensation of the lowered activity upon developing process (replenishing for process exhaust) and a replenishing solution for compensation of the lowered activity upon oxidation with time (replenishing for time exhaust) are replenished by the use of separate replenishing solutions. However, the said system requires controlling of replenishing balance between two solutions and thus has a drawback of complicated equipments and procedures.

On the other hand, there has been proposed a method for producing a high contrast image by processing with a black-and-white developing solution having a high sulfite ion concentration, namely a P(M)Q type developing solution without using a special lith-type developing solution.

As the said process, there has been illustratively proposed a method wherein a 2H-tetrazolium salt compound is incorporated into a silver halide photographic material (see U.S. Pat. Nos. 4,175,966 and 4,210,715).

According to the latter process, a high sulfite ion concentration can be maintained in a developing solution and a stable processing can be effected under enhanced preservative conditions.

However, the said process can provide a high contrast silver image, but a flange-like haze is developed at an outline portion of dot owing to a low contrast from a low density portion called a toe portion, the so-called fogging density, through a density of up to about 0.2 and hence it is still unsatisfactory and open to improvement in view of a clear dot quality even with a high edge contrast.

An object of this invention is to provide a silver halide photographic material which can provide a high contrast silver image and a clear dot quality by using a stable developing solution, and a method for the formation of an image.

The present inventors have found that the aforesaid object can be accomplished by a light-sensitive silver halide photographic material comprising a support and, coated thereon, a hydrophilic colloid layer or layers including a silver halide emulsion layer, at least one of said hydrophilic colloid layer or layers containing a 1H-tetrazolium compound. Also, it has been found that the object of this invention can be more favourably accomplished by processing the said photographic material with a developing solution containing at least one of developing inhibitors (retarders) represented by the general formula [I].

The general formula [I]:

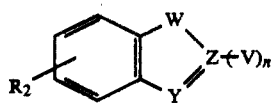

wherein Y is a nitrogen atom or a methine group, Z is a nitrogen atom or a carbon atom, W is a sulfur atom, an oxygen atom or an imino group and V is a hydrogen atom or a mercapto group; provided that at least one of Y and Z is a nitrogen atom and, when Y represents a methine group, W is an imino group; n is 0 or 1; and, when Z is a nitrogen atom, n is 0 and, when Z is a carbon atom, n is 1; $R_2$ is a hydrogen atom, a lower alkyl group, a halogen atom or a nitro group.

The 1H-tetrazolium compound, which may be employed in this invention, may typically include the compounds represented by the following general formula [II] or [III].

The general formula [II]:

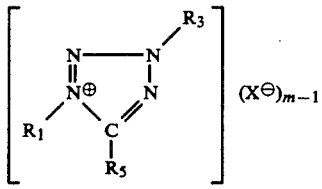

The general formula [III]:

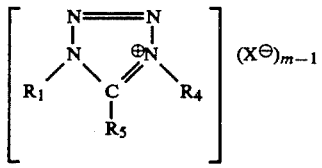

In the formula, $R_1$, $R_3$, $R_4$ and $R_5$ are individually selected from an unsubstituted or substituted alkyl group (e.g. a methyl group, an ethyl group, a propyl group, a tert-butyl group and so on), an allyl group, a phenyl group (e.g. a phenyl group, a tolyl group, a hydroxyphenyl group, an alkoxyphenyl group, a carboxyphenyl group, an alkoxycarbonylphenyl group, an aminophenyl group, a mercaptophenyl group, a sulfoxyphenyl group, an aminosulfoxyphenyl group, a nitrophenyl group, a halogenated phenyl group and so on), a naphthyl group (e.g. an α-naphthyl group, a β-naphthyl group, a hydroxynaphthyl group, a carboxynaphthyl group, an aminonaphthyl group and so on) and a heterocyclic group (e.g. a thiazolyl group, a benzothiazolyl group, an oxazolyl group, a pyrimidyl group, a pyridyl group, a pyrazolyl group and so on) and all said groups may be groups capable of forming a metal chelate or complex.

Further, $R_5$ may be, in addition to the foregoing groups, a hydroxy group, an alkoxy group, a carboxy group, an alkoxycarbonyl group, a mercapto group, an alkoxysulfide group or a cyano group.

$X^{\ominus}$ represents an anion and may be any of anions commonly known.

m is 1 or 2 provided that, when the compound forms the corresponding inner salt depending upon the substituent type of $R_5$, m is 1.

Illustrative examples of the 1H-tetrazolium compounds which may be employed in this invention are given below, but it is to be noted that those compounds employable for this invention are not limited thereto.

(1) 1,5-Dimethyl-4-phenyl-1H-tetrazolium chloride
(2) 1,5-Dimethyl-4-(3,4-xylyl)-tetrazolium chloride
(3) 5-Hydroxy-1,3-bis(p-nitrophenyl)-1H-chloride
(4) 1,3,5-Tri(p-carboxyethylphenyl)-1H-tetrazolium chloride
(5) 1-(Benzthiazol-2-yl)-3-phenyl-5-(o-chlorophenyl)-2H-tetrazolium bromide
(6) 4,5-Dimethyl-1-phenyl-1H-tetrazolium chloride
(7) 4,5-Dimethyl-1-(3,4-xylyl)-1H-tetrazolium chloride
(8) 3-(p-Hydroxyphenyl)-5-methyl-1-phenyl-1H-tetrazolium chloride
(9) 1,3-Diphenyl-5-ethyl-1H-tetrazolium bromide
(10) 1,3-Diphenyl-5-n-hexyl-1H-tetrazolium bromide
(11) 5-Cyano-1,3-diphenyl-1H-tetrazolium bromide
(12) 1,4,5-Triphenyl-1H-tetrazolium chloride
(13) 1-(Benzothiazol-2-yl)-5-(4-chlorophenyl)-3-(4-nitrophenyl)-1H-tetrazolium chloride
(14) 5-Hydroxy-1,3-diphenyl-1H-tetrazolium hydroxide intramolecular salt
(15) 5-Acetyl-1,3-di(p-ethoxyphenyl)-1H-tetrazolium bromide
(16) 1,5-Diphenyl-3-(p-tolyl)-1H-tetrazolium chloride
(17) 1,5-Diphenyl-3-(p-iodophenyl)-1H-tetrazolium chloride
(18) 1,3-Diphenyl-5-(p-diphenyl)-1H-tetrazolium chloride
(19) 5-[p-(p-Acetamidoanilino)phenylazo]-1,4-dimethyl-1H-tetrazolium chloride
(20) 5-(p-Dimethylaminostyryl)-4-ethyl-1-phenyl-1H-tetrazolium chloride
(21) 3,5-Diallyl-1-(tetrazol-5-yl)-1H-tetrazolium chloride
(22) 1-Cyclohexyl-4,5-dimethyl-1H-tetrazolium chloride
(23) 3-(p-Acetamidophenyl)-1,5-diphenyl-1H-tetrazolium bromide
(24) 5-Acetyl-1,3-diphenyl-1H-tetrazolium bromide
(25) 1-(m-Chlorophenyl)-4,5-dimethyl-1H-tetrazolium chloride
(26) 1-Cyclohexyl-4,5-dimethyl-1H-tetrazolium chloride
(27) 1-(o-Chlorophenyl)-4,5-dimethyl-1H-tetrazolium chloride
(28) 1-(p-Bromophenyl)-4,5-dimethyl-1H-tetrazolium chloride
(29) 4,5-Dimethyl-1-p-tolyl-1H-tetrazolium chloride In the present tetrazolium compounds, the anion represented by $X^{\ominus}$ may include, for example, a halide ion such as chloride ion, bromide ion, iodide ion; an acid radical of an inorganic acid such as nitric acid, sulfuric acid, perchloric acid; an acid radical of an organic acid such as a sulfonic acid, a carboxylic acid; an anionic surfactant such as a lower alkylbenzene sulfonic acid anion, e.g. p-toluenesulfonic acid anion, a higher alkylbenzenesulfonic acid anion, e.g. p-dodecylbenzenesulfonic acid anion, a higher alkyl sulfuric acid ester anion, e.g. lauryl sulfate anion, a boric acid type anion, e.g. tetraphenyl boron, a dialkyl sulfosuccinate anion, e.g. di-2-ethylhexyl sulfosuccinate anion, a polyether alcohol sulfuric acid ester anion, e.g. cetyl polyethenoxy sulfate anion, a higher aliphatic acid anion, e.g. stearate anion, a polymer having a bound acid radical, e.g. polyacrylate anion and the like.

The tetrazolium compound which may be employed in this invention can provide favourable properties if employed alone, but, when the two or more thereof are combined at any ratio, no deterioration of favourable properties would be observed.

One of preferable embodiments in this invention is to incorporate the present tetrazolium compound into a silver halide emulsion layer. Also, another preferable embodiment of this invention is to incorporate the present tetrazolium compound into a hydrophilic colloid layer either directly adjacent to a hydrophilic colloid layer including a silver halide emulsion layer or adjacent to said hydrophilic colloid layer via an interlayer.

In a still another embodiment, the present tetrazolium compound may be dissolved in a suitable organic solvent such as an alcohol, e.g. methanol or ethanol, an ether or an ester and coated directly to the part to be the most outer layer of a silver halide photosensitive material, thereby incorporating into said silver halide photosensitive material.

The tetrazolium compound, which may be empolyed in this invention, is usually applied in the range of $1\times10^{-6}$ to 10 moles per mole of silver halide, particularly preferably $2\times10^{-5}$ to $2\times10^{-1}$ mole.

The silver halide employable for the silver halide photographic photosensitive material to which this invention is applied, may include any of those usually employed for a conventional silver halide photographic emulsion, e.g. silver bromide, silver chlorobromide, silver iodobromide, silver chloroiodobromide, silver chloride and the like. Particularly when employed as a daylight reversal photosensitive material to be exposed by means of a printer using as a light source a metal halide or a high pressure mercury lamp, a silver halide composition containing not less than 70 molar % of silver chlorobromide is preferable. These silver halides may be of a coarse grain or a fine grain and prepared according to any well-known methods such as those disclosed in U.S. Pat. Nos. 2,592,250, 3,276,877, 3,317,322, 2,222,264, 3,320,069 and 3,206,313 or J. Photo. Sci. 12, No. 5 (the September & October Number), 242–251 (1964) and so on. Also, the silver halides prepared by different methods may be employed in any combination therewith.

The silver halide to be incorporated into the present silver halide emulsion layer, though not critical, has an average grain size of 0.05 to 1.5$\mu$, preferably 0.1 to 0.5$\mu$, and contains desirably the silver halide wherein at least 75%, preferably not less than 80% of a whole grain number have a grain size of 0.5 to 1.5 times, preferably 0.6 to 1.4 times that of the above-mentioned average grain size.

According to one of the most preferable embodiment of this invention, the present silver halide is silver chloroiodobromide or chlorobromide having an average grain size of 0.10 to 0.3$\mu$, wherein not less than 80% of a whole grain number have 0.6 to 1.4 times grain size of the average grain size.

Moreover, these silver halides may include within crystalline grains such atoms as iridium, rhodium, osmium, bismuth, cobalt, nickel, palladium, ruthenium, iron, copper, zinc, lead, cadmium and the like. Where said atom is incorporated, it is preferable to incorporate it at $10^{-8}$ to $10^{-2}$ mole per mole of silver halide, particularly preferably at $10^{-6}$ to $10^{-4}$ mole. Further, the silver halide may be of a surface latent image type or an internal latent image type. Also, any silver halides prepared by various different methods may be admixed. There is no limitation on crystal shape(form) and then there may be any shape of a hexahedron, an octahedron, a tetradecahedron or a sphere.

The above-mentioned silver halide and tetrazolium compound which may be employed in this invention is incorporated into a hydrophilic colloid layer. The hydrophilic colloid which may be particularly usefully employed in this invention is gelatin, but other hydrophilic colloids than gelatin may include, for example, colloidal albumin; agar; gum arabic; alginic acid; a hydrolyzed cellulose acetate; acrylamide; and imidated polyamide; polyvinyl alcohol; a hydrolyzed polyvinyl acetate; a gelatin derivative such as phenylcarbamyl gelatin, acrylated gelatin, phathalated gelatin as disclosed, for example, in U.S. Pat. Nos. 2,614,928 and 2,525,753, a graft polymer of gelatin with a polymerizable monomer having an ethylene group such as styrene acrylate, acrylic acid ester, methacrylic acid, methacrylic acid ester and the like as disclosed, for example, in U.S. Pat. Nos. 2,548,520 and 2,831,767; and the like. The hydrophilic colloid may be applied to a layer containing no silver halide, for example, an antihalation coating, a protecting layer, an interlayer and the like.

The silver halide photographic photosensitive material of this invention comprises a suitable photographic base or support having coated thereon a hydrophilic colloid layer containing the silver halide and tetrazolium compound for this invention.

Representative example of the support which may be employed in this invention may include a baryta paper, a polyethylene-coated paper, a polypropylene synthetic paper, a glass plate, a cellulose acetate, a cellulose nitrate, a polyester (e.g. polyethylene terephthalate) film, a polyamide film, a polypropylene film, a polycarbonate film, a polystyrene film and the like. The supports may be properly selected for the purpose of application of respective silver halide photosensitive materials.

As explained above, the present silver halide photographic photosensitive material comprises a support including a photosensitive silver halide emulsion layer wherein a 1H-tetrazolium compound is incorporated into at least one of the hydrophilic colloid layers coated over said emulsion layer, but the present silver halide photosensitive material has desirably a protective layer having an adequate film thickness, namely a gelatin protective layer coated thereon of preferably 0.1 to 10$\mu$, particularly preferably 0.8 to 2$\mu$.

The said hydrophilic colloid may involve, if necessary, a variety of photographic additives, for example, a gelatin plasticizer, a hardening agent, a surface active agent, an image stabilizer, an ultraviolet absorber, an antistain agent, a pH adjusting agent, an antioxidant, an antistatic agent, a thickening agent, a grainness improving agent, a dye, a mordant, a brightening agent, a developing speed regulator, a matting agent and the like to the extent that effect of this invention could not be adversely affected.

Of the above-mentioned additives, there may be particularly preferably employed the following; for instance, as the thickening agent or plasticizer those compounds as disclosed in U.S. Pat. No. 2,960,404, Japanese Patent (Publication No. 4939/1968, German Patent Publication (DAS) No. 1,904,604, Japanese Patent Laid-Open Application No. 63715/1973, Japanese Patent Publication No. 15462/1970, Belgian Pat. No. 763,833, U.S. Pat. No. 3,767,410, Belgian Pat. No. 558,143 such as a styrene-sodium maleic acid copolymer, dextran sulfate and the like, as the hardening agent aldehyde-, epoxy-, ethyleneimine-, active halogen-, vinylsulfone-, isocyanate-, sulfonate-, carbodiimide-, mucochloric acid-, acryloyl-type hardening agents, as the ultraviolet absorber, for example, the compounds as disclosed in U.S. Pat. No. 3,253,921 and British Pat. No. 1,309,349, particularly 2-(2'-hydroxy-3-tert-butylphenyl)benzotriazole, 2-(2'-hydroxy-3',5'-di-tert-butylphenyl)benzotriazole, 2-(2'-hydroxy-3'-tert-butyl-5'-butylphenyl)-5-chlorobenzotriazole, 2-(2'-hydroxy-3',5'-di-tert-butyl-phenyl)-5-chlorobenzotriazole and the like may be mentioned. As the dye, there may be used those compounds as disclosed in U.S. Pat. No. 2,072,908, German Pat. No. 107,990, U.S. Pat. No. 3,048,487, U.S. Pat. No. 515,998 and the like. Such compound may be incorporated into a protective layer, an emulsion layer or an interlayer. Moreover, as the coating aid, emulsifier or the improving agent for permeability to the treating solution and so on, the antifoaming agent or the surface active agent to control physical properties of a photosensitive material, there may be employed the anionic, cationic, non-ionic or amphoteric compounds as disclosed in British Pat. Nos. 548,532, 1,216,389, U.S. Pat. Nos. 3,026,202, 3,514,293, Japanese Patent Publications No. 26580/1969, No. 17922/1968, No. 17926/1968, No. 13166/1968, No. 20785/1973, French Pat No. 202,588, Belgian Pat. No. 773,459, Japanese Patent Laid-Open Application No. 101118/1973 and so on. As the antistatic agent, there may be mentioned the compounds as disclosed in Japanese Patent Publication No. 24159/1971, Japanese Patent Laid-Open Application No. 89979/1973, U.S. Pat. Nos. 2,882,157, 2,972,535, Japanese Patent Laid-Open Applications No. 20785/1973, No. 43130/1973, No. 90391/1973, Japanese Patent Publications No. 24159/1971, No. 39312/1971, No. 43809/1973, Japanese Patent Laid-Open Application No. 33627/1972 and so on. As the matting agent, there may be mentioned the compounds, for example, as disclosed in British Pat. No. 1,221,980, U.S. Pat. Nos. 2,992,101, 2,956,884, French Pat. No. 1,395,544, Japanese Patent Publication No. 43125/1973 and so on, especially silica gel having a particle size of 0.5 to 20$\mu$, a polymer of polymethylmethacrylate having a particle size of 0.5 to 20$\mu$ and the like.

As the developing agent to be incorporated into the developing solution which may be employed for development of the present photosensitive material, there may be mentioned the following:

As a HO—(CH=CH)$_n$—OH type developing agent, typically, catechol, pyrogallol, derivatives thereof and ascorbic acid, hydroquinone, chlorohydroquinone, bromohydroquinone, isopropylhydroquinone, toluhydroquinone, methylhydroquinone, 2,3-dichlorohydroquinone, 2,5-dimethylhydroquinone, 2,3-dibromohydroquinone, 2,5-dihydroxyacetophenone, 2,5-diethylhydroquinone, 2,5-di-p-phenethylhydroquinone, 2,5-dibenzoylaminohydroquinone, 4-chlorocatechol, 3-phenylcatechol, 4-phenylcatechol, 3-methoxycatechol, 4-acetylpyrogallol, 4-(2'-hydroxybenzoyl)-pyrogallol, sodium as corbate and the like.

As a HO—(CH=CH)$_n$—NH$_2$ type developing agent, typically, o- and p-aminophenol or aminopyrazolone, 4-aminophenol, 2-amino-6-phenylphenol, 2-amino-4-chloro-6-phenylphenol, 4-amino-2-phenylphenol, 3,4-diaminophenol, 3-methyl-4,6-diaminophenol, 3-methyl-4,6-diaminophenol, 2,4-diaminoresorcinol, 2,4,6-triaminophenol, N-methyl-p-aminophenol, N-$\beta$-hydroxyethyl-p-aminophenol, p-hydroxyphenylaminoacetic acid, 2-aminonaphthol and the like.

As a H$_2$N—(C=C)$_n$—NH$_2$ type developing agent, for instance, 4-amino-2-methyl-N,N-diethylaniline, 2,4-diamino-N,N-diethylaniline, N-(4-amino-3-methylphenyl)morpholine, p-phenylenediamine, 4-amino-N,N-dimethyl-3-hydroxyaniline, N,N,N',N'-tetramethylparaphenylenediamine, 4-amino-N-ethyl-N-($\beta$-hydroxyethyl)aniline, 4-amino-3-methyl-N-ethyl-N-($\beta$-hydroxyethyl)aniline, 4-amino-N-ethyl-($\beta$-methoxyethyl)-3-methylaniline, 4-amino-3-methyl-N-ethyl-N-($\beta$-methylsulfonamidoethyl)aniline, 4-amino-N-butyl-N-$\gamma$-sulfobutylaniline, 1-(4-aminophenyl)pyrrolidine, 6-amino-1-ethyl-1,2,3,4-tetrahydroquinoline, 9-aminouridine and the like.

As a heterocyclic type developing agent, for example, 1-phenyl-3-pyrazolidone(phenidone), 1-phenyl-4-amino-5-pyrazolone, 1-(p-aminophenyl)-3-amino-2-pyrazoline, 1-phenyl-3-methyl-4-amino-5-pyrazolone, 4,4'(-dimethyl-)1-phenylpyrazolidone(dimezone), 5-aminouracil, 5-amino-2,4,6-trihydroxyphilimidene and the like. Besides, such developing agents as those disclosed in "The Theory of the Photographic Process" by T. H. James, the 4th Ed., 291–334 and Journal of the American Chemical Society, 73, 3100(1951) may be effectively employed in this invention. These developing agents may be applied either alone or in combination with the two or more, but it is preferable to use combination of the two or more. Preferred combination is hydroquinone and phenidone or hydroquinone and dimezone and it is preferable to use 5 to 50 g/l of hydroquinone and 0.05 to 5 g/l of phenidone or dimezone. Also, the developing solution employable in this invention may include as a preservative, for example, a sulfinic acid salt, e.g. sodium sulfite, potassium sulfite, ammonium sulfite and the like to give no adverse action on the present effect, which is one of the features in this invention. Preferable sulfite concentration is 0.06 to 1 gramion/l. As the preservative, there may be also employed hydroxylamine or hydrazide compounds. Additionally, it is optional to adjust a pH value with buffering action by the use of caustic alkali, alkali carbonate or amine as generally employed in a black-and-white developing solution or to add an inorganic development retarder, e.g. potassium bromide, a metal ion trapping (sequestering) agent, e.g. ethylenediamine tetraacetic acid, a development accelerator, e.g. methanol, ethanol, benzylalcohol, polyalkylene oxide, a surface active agent, e.g. sodium alkylarylsulfonate, natural saponin, sugar or alkyl ester of the above-mentioned compounds, a hardening agent, e.g. glutaraldehyde, formalin, glyoxal, an ionic strength regulator, e.g. sodium sulfate and the like. A pH value may be optionally set in 9 to 12, but a pH range of 10 to 11 is preferably employed in view of preservative property and photographic efficiency. Optionally, an alkanolamine or glycol may be incorporated as an organic solvent into a developing solution.

As the alkanolamine, there may be mentioned, for example, monoethanolamine, diethanolamine, triethanolamine and the like, preferably triethanolamine. A preferred amount of the alkanolamine used is 20 to 500 g per liter of the developing solution, particularly preferably 60 to 300 g per liter of the developing solution.

As the glycol, there may be mentioned, for example, ethylene glycol, diethylene glycol, propylene glycol, triethylene glycol, 1,4-butanediol, 1,6-pentanediol and the like, preferably diethylene glycol. A preferred amount of the glycol used is 20 to 500 g per liter of the developing solution, particularly preferably 60 to 300 g per liter of the developing solution.

The said alkanolamine and glycol may be applied either alone or in combination with the two or more.

Preferable compounds represented by the general formula [I], which may be employed in the present image forming process, may include 5-nitroindazole, 6-nitroindazole, 5-methylbenzotriazole, 6-methylbenzotriazole, 5-nitrobenzoimidazole, 1-phenyl-5-mercaptotetrazole and the like. A preferred amount of the development retarder used is $10^{-1}$ to $10^{-5}$ mole per liter of the developing solution, particularly $10^{-2}$ to $10^{-4}$ mole per liter of the developing solution being preferable. It is also preferable to dissolve the above development retarder in an alkanolamine or glycol and then add the solution to a developing solution.

The present photographic photosensitive material may be processed under various conditions. Processing temperature, for example, developing temperature is preferably not higher than 50° C., particularly approximate 30° C. being preferable. Developing period of time is generally within 3 minutes, but satisfactory results can be often accomplished particularly preferably within 2 minutes. It is also optional to adopt or eliminate other processing steps than development such as water-washing, stop, stabilization, fix and, as required, prehardening, neutralization and so on. These processings may be effected by means of manual development processing or mechanical development such as roller development, Hanger development.

This invention will be more concretely explained by way of the following examples. The present technical scope is not limited by the following examples, but various embodiments are feasible.

Particular reference to the present embodiments will be given with a slow silver halide photographic material, the so-called daylight type silver halide photographic material, but the present invention is not limited by them to any extent.

EXAMPLE 1

A silver chlorobromide emulsion (a composition: silver chloride 90 molar %, silver bromide 10 molar %) having an average grain size of 0.18 μ was prepared by a simultaneous mixing method wherein to the Solution A having the following formulation while maintained at 42° C. were added the Solutions B and C over 30 minutes. After 5 minutes of completion of physical-ripening, grain growth was stopped by the addition of 3 g of 4-hydroxy-6-methyl-1,3,3a,7-tetrazaindane, desalting and water-washing were repeated three times, gelatin for dispersion was added, dispersion was made at 50° C. for 30 minutes, 0.16 g of sodium thiosulfate was added as a chemical sensitizer and then ripening was continued for further 60 minutes. At the completion of ripening, 3 g of 4-hydroxy-6-methyl-1,3,3a,7-tetrazaindane and 160 g of a 10% aqueous solution of gelatin were added and then pure water was added to the resulting emulsion to make up to 5 l.

| | |
|---|---|
| Solution A | |
| Pure water | 3.5 l |
| Gelatin | 160 g |
| Solution B | |
| Pure water | 4.7 l |
| Potassium bromide | 56 g |
| Sodium chloride | 413 g |
| Potassium hexachlororhodium hydrochloride.12 hydrate | 266 mg |
| Solution C | |
| Pure water | 4.7 l |
| Silver nitrate | 1 kg |

A coating solution was prepared as stated below by using the above-mentioned emulsion made up to 5 l, thereby producing Sample 1 (Comparative Sample).

Preparation of Coating Solution E1

500 ml of the above-mentioned emulsion were taken and 30 cc of 20% saponin as a coating aid and 10 g of a styrene-maleic acid copolymer as a thickening agent were added and made up to 5 l, thereby producing Coating Solution E1.

Preparation of Coating Solution P1 for a protecting film of an emulsion

To 1 kg of gelatin were added 10 l of pure water. After swelling, the mixture was heated to 40° C., 3 l of a 1% aqueous solution of sodium diethylsulfosuccinate sulfonate as a coating aid and 1 l of a 10% aqueous solution of the following compound f1 as a filter dye were added and then a dispersion of 30 g of a methyl methacrylate copolymer having an average grain size of 0.3μ was added to make up to 20 l.

Compound f1

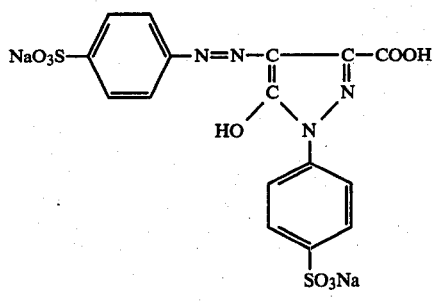

Preparation of Back Coating Solution B1

To 1 kg of gelatin were added 20 l of pure water. After swelling, the mixture was heated to 40° C., the above-mentioned compound f1 used as an additive for a protective film solution for an emulsion and 800 cc of each of 10% aqueous solutions of the above-mentioned compound f1 employed as an additive for a protective film solution of an emulsion and the following compound f2, 16 g of a styrene-maleic acid copolymer as a thickening agent and 16 g of saponin as a coating aid were added and made up to 30 l with pure water.

Compound f2 (dye)

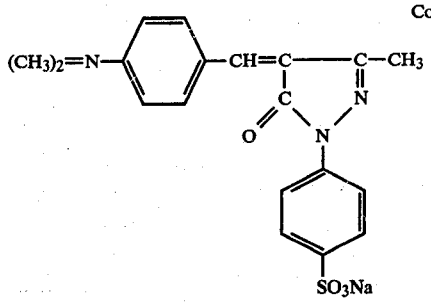

Preparation of Back Protecting Film Solution B2

Prepared in the same manner as done for the emulsion protective film solution except that the above dye f1 was omitted.

Preparation of silver halide photographic material

Onto an undercoated (subbed) polyethylene terephthalate were coated the Back Coating Solution B1 and its Coating film B2 by means of a simultaneous interlayer coating machine so that an added amount of gelatin was 2 g/m$^2$ in the former and 1 g/m$^2$ in the latter. Similarly, a combination of the emulsion coating solution and its protective film solution was coated over the opposite surface of the above base so that a silver amount was 4 g/m$^2$ and an added amount of gelatin in a protective film was 1 g/m$^2$. Moreover, when the back coating solution and protective film solution therefor were coated over the support and the emulsion layer and the protective film solution therefor were coated over the opposite surface thereof, a formalin hardener and an ethylene imine hardener were added to all protective film solutions and then hardening was effected.

Preparation of Sample 2 (Comparative Sample)

Following the same procedures as in the Sample 1 except that 300 cc of a 1% aqueous solution of 2,3,5-triphenyl-2H-tetrazolium chloride as an additive in preparing a coating solution E1 was added, the said sample was prepared.

Preparation of Sample 3

Following the same procedures as in the Sample 2, 250 cc of a 1% methanol aqueous solution of Illustrative Compound (12) were used instead of the 2,3,5-triphenyl-2H-tetrazolium chloride.

Preparation of Sample 4

Following the same procedures as in the Sample 3 except that 300 cc of a 1% methanol aqueous solution of Illustrative Compound (6) were used instead of the Illustrative Compound (12), the said sample was prepared.

The above test sample was exposed by conducting reversal printing at a quantity of light of 10 mJ with an ultraviolet daylight printer (DRC Seisakusho, HMW-215) using an ultra-high pressure mercury lamp as a light source.

An original copy employed for the said exposure was a dot-formed original copy (dot-formed through a contact screen of 150 L) having a blackening ratio of 10%, 50% or 90% and the reversal printed sample was of approximate 1:1 reversal. The exposed sample was processed under the following processing conditions in a roller convey type automatic developing machine (with a developer tank capacity of 40 l) containing a developer having the following formulations and a commercially available fixer.

For preparing 1 l of a developer, there were employed the following Part A composition and Part B composition previously made up. When used, the Part A and Part B were in turn dissolved in 500 ml of pure water to make up to 1 l.

| | |
|---|---|
| Part A | |
| Pure water | 150 ml |
| Ethylenediaminetetraacetic acid.disodium salt | 2 g |
| 50% aqueous solution of potassium sulfite | 100 ml |
| Potassium carbonate | 50 g |
| Hydroquinone | 10 g |
| 5-Methylbenzotriazole | 200 mg |
| 1-Phenyl-5-mercaptotetrazole | 0.03 g |
| Part B | |
| Diethylene glycol | 50 g |
| Pure water | 3 ml |
| Ethylenediaminetetraacetic acid.disodium salt | 25 mg |
| 90% Acetic acid | 0.3 ml |
| 5-Nitroindazole | 110 mg |
| 1-Phenyl-3-pyrazolidone | 0.2 g |
| 55% Aqueous solution of potassium carbonate | 1 ml |
| Processing conditions | |
| Development: Temp. 30° C. | 30 seconds |
| Fix: Temp. 30° C. | 20 seconds |
| Water washing: Temp. 30° C. | 20 seconds |

Each processed sample was observed by means of a 100× magnifying lens on dot quality after reversal printed.

The case where dot has a clear outline and edge contrast is highest is evaluated as "5.0", while the case where dot has an unclear outline and many fringes is evaluated as "1.0" to effect dot quality evaluation. The results are shown in the following Table-1.

TABLE 1

| | Dot density % | Sample 1 | 2 | 3 | 4 |
|---|---|---|---|---|---|
| Dot quality | 10% | 1 | 3.0 | 4.5 | 5.0 |
| | 50% | 2 | 3.5 | 5.0 | 5.0 |
| | 90% | 1 | 3.0 | 4.5 | 5.0 |

As apparent from the above results, it can be seen that a very high quality can be obtained when reversal printed with the present compound.

EXAMPLE 2

A photosensitive material was prepared in the same manner as in the Sample 3 of Example 1 and exposed by conducting 3 sheets-tiered multilayer printing at a light quantity of 10 mJ with an ultraviolet daylight printer (DRC Seisakusho, HMW-215) using an ultra-high pressure mercury lamp as a light source.

An original copy employed above was a 50% dot-formed original copy (dot-formed through a contact screen of 150 L) and the reversal printed sample processed in the same manner as in Example 1 except for the following point. As a developer, there was employed the same developing solution as in Example 1 except that the compound and content indicated in Table-2 were applied instead of the 5-methylbenzotriazole and 1-phenyl-5-mercaptotetrazole in the developer Part A and the 5-nitroindazole in the Part B, respectively.

TABLE 2

| Composition | | Test No. 1 | 2 | 3 | 4 | 5 |
|---|---|---|---|---|---|---|
| Part | Development | | 5-Methyl- | | 5-Methyl- | 1-Phenyl- |

TABLE 2-continued

| Composition | | Test No. 1 | 2 | 3 | 4 | 5 |
|---|---|---|---|---|---|---|
| A | retarder | benzotriazole | | benzo-trizaole | 5-mercapto-tetrazole | |
| | Added amount | | | 200 mg | 30 mg | |
| Part B | Development retarder | | 5-Nitro-indazole | | 5-Nitro-indazole | 5-Nitro-benzimi-dazole |
| | Added amount | | 100 mg | | 100 mg | 300 mg |

After developed, samples were evaluated according to Example 1. The results are given in Table-3.

TABLE 3

| | Test No. 1 | 2 | 3 | 4 | 5 |
|---|---|---|---|---|---|
| Dot quality | 4.0 | 4.5 | 4.5 | 5.0 | 4.5 |

It can be seen from the above results that a good dot quality can be obtained by development using the present development retarder.

What is claimed is:

1. A light-sensitive silver halide photographic material comprising a support and, coated thereon, a hydrophilic colloid layer or layers including a silver halide emulsion layer, at least one of said hydrophilic colloid layer or layers containing a 1H-tetrazolium compound.

2. A light-sensitive silver halide photographic material according to claim 1, wherein said 1H-tetrazolium compound is represented by the formula:

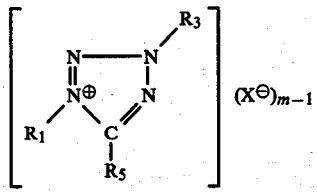

or the formula:

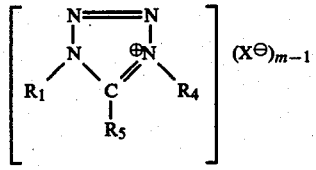

wherein $R_1$, $R_3$, $R_4$ and $R_5$ each represent a substituted or unsubstituted alkyl group, an allyl group, a phenyl group which may be substituted, a naphthyl group which may be substituted or a hetrocyclic group, and $R_5$ may additionally be a hydroxyl group, an alkoxy group, a carboxyl group, an alkoxycarbonyl group, a mercapto group, an alkoxysulfide group or a cyano group; $X^{\ominus}$ is an anion; and m is 1 or 2 provided that, when the compound forms the corresponding inner salt depending upon the substituent type of $R_5$, m is 1.

3. A light-sensitive silver halide photographic material according to claim 2, wherein said alkyl group is methyl, ethyl, propyl or tert-butyl; said phenyl is phenyl, tolyl, hydroxyphenyl, alkoxyphenyl, carboxyphenyl, alkoxycarbonylphenyl, aminophenyl, mercaptophenyl, sulfoxyphenyl, aminosulfoxyphenyl, nitrophenyl or halogenated phenyl; said naphthyl group is α-naphthyl, β-naphthyl, hydroxynaphthyl, carboxynaphthyl or aminonaphthyl; and said heterocyclic group is thiazolyl, benzothiazolyl, oxazolyl, pyrimidyl, pyridyl or pyrazolyl.

4. A light-sensitive silver halide photographic material according to claim 2, wherein said 1H-tetrazolium compound is selected from the group consisting of the following compounds:

(1) 1,5-Dimethyl-4-phenyl-1H-tetrazolium chloride
(2) 1,5-Dimethyl-4-(3,4-xylyl)-tetrazolium chloride
(3) 5-Hydroxy-1,3-bis(p-nitrophenyl)-1H-chloride
(4) 1,3,5-Tri(p-carboxyethylphenyl)-1H-tetrazolium chloride
(5) 1-(Benzthiazol-2-yl)-3-phenyl-5-(o-chlorophenyl)-2H-tetrazolium bromide
(6) 4,5-Dimethyl-1-phenyl-1H-tetrazolium chloride
(7) 4,5-Dimethyl-1-(3,4-xylyl)-1H-tetrazolium chloride
(8) 3-(p-Hydroxyphenyl)-5-methyl-1-phenyl-1H-tetrazolium chloride
(9) 1,3-Diphenyl-5-ethyl-1H-tetrazolium bromide
(10) 1,3-Diphenyl-5-n-hexyl-1H-tetrazolium bromide
(11) 5-Cyano-1,3-diphenyl-1H-tetrazolium bromide
(12) 1,4,5-Triphenyl-1H-tetrazolium chloride
(13) 1-(Benzothiazol-2-yl)-5-(4-chlorophenyl)-3-(4-nitrophenyl)-1H-tetrazolium chloride
(14) 5-Hydroxy-1,3-diphenyl-1H-tetrazolium hydroxide intramolecular salt
(15) 5-Acetyl-1,3-di(p-ethoxyphenyl)-1H-tetrazolium bromide
(16) 1,5-Diphenyl-3-(p-tolyl)-1H-tetrazolium chloride
(17) 1,5-Diphenyl-3-(p-iodophenyl)-1H-tetrazolium chloride
(18) 1,3-Diphenyl-5-(p-diphenyl)-1H-tetrazolium chloride
(19) 5-[p-(p-Acetamidoanilino)phenylazo]-1,4-dimethyl-1H-tetrazolium chloride
(20) 5-(p-Dimethylaminostyryl)-4-ethyl-1-phenyl-1H-tetrazolium chloride
(21) 3,5-Diallyl-1-(tetrazol-5-yl)-1H-tetrazolium chloride
(22) 1-Cyclohexyl-4,5-dimethyl-1H-tetrazolium chloride
(23) 3-(p-Acetamidophenyl)-1,5-diphenyl-1H-tetrazolium bromide
(24) 5-Acetyl-1,3-diphenyl-1H-tetrazolium bromide
(25) 1-(m-Chlorophenyl)-4,5-dimethyl-1H-tetrazolium chloride
(26) 1-Cyclohexyl-4,5-dimethyl-1H-tetrazolium chloride
(27) 1-(o-Chlorophenyl)-4,5-dimethyl-1H-tetrazolium chloride
(28) 1-(p-Bromophenyl)-4,5-dimethyl-1H-tetrazolium chloride

(29) 4,5-Dimethyl-1-p-tolyl-1H-tetrazolium chloride.

5. A light-sensitive silver halide photographic material according to claim 1, wherein said 1H-tetrazolium compound is incorporated in the silver halide emulsion layer.

6. A light-sensitive silver halide photographic material according to claim 1, wherein said 1H-tetrazolium compound is incorporated in a hydrophilic colloid layer directly adjacent to a hydrophilic colloid layer including a silver halide emulsion layer or in a hydrophilic colloid layer adjacent to said latter hydrophilic colloid layer via an intermediate layer.

7. A light-sensitive silver halide photographic material according to claim 1, wherein the amount of said 1H-tetrazolium compound is in the range of $1\times10^{-6}$ to 10 molar % per one mole of the silver halide contained in the light-sensitive silver halide photographic material.

8. A light-sensitive silver halide photographic material according to claim 1, wherein said silver halide has an average grain size of 0.05 to 1.5μ and at least 75% of a whole grain number has a grain size of 0.5 to 1.5 times that of the average grain size.

9. A light-sensitive silver halide photographic material according to claim 8, wherein said silver halide is silver chloroiodobromide or silver chlorobromide having an average grain size of 0.10 to 0.3μ, at least 80% of a whole grain number having a grain size of 0.6 to 1.4 times that of the average grain size.

10. A light-sensitive silver halide photographic material according to claim 1, wherein said silver halides include within crystalline grains atoms of one or more elements selected from iridium, rhodium, osmium, bismuth, cobalt, nickel, palladium, ruthenium, iron, copper, zinc, lead and cadmium.

11. A light-sensitive silver halide photographic material according to claim 10, wherein said atoms are included in an amount of $10^{-8}$ to $10^{-2}$ mole per one mole of said silver halides.

12. An image-forming method which comprises processing a light-sensitive silver halide photographic material of claim 1 with a developing solution containing at least one of development inhibitors represented by the following general formula [I], general formula [I]:

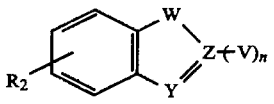

(wherein Y is a nitrogen atom or a methine group; Z is a nitrogen atom or a carbon atom; W is a sulfur atom, an oxygen atom or an imino group; V is a hydrogen atom or a mercapto group, provided that at least one of Y and Z is a nitrogen atom; and when Y represents a methine group, W is an imino group; n is 0 or 1; and, when Z is a nitrogen atom, n is 0 and, when Z is a carbon atom, n is 1; $R_2$ is a hydrogen atom, a lower alkyl group, a halogen atom or a nitro group.).

13. An image-forming method according to claim 12, wherein said developing solution contains, as a developing agent, a combination of hydroquinone and phenidone or a combination of hydroquinone and dimezone, the amount of the hydroquinone being 5 to 50 g/l and the amount of the phenidone or the dimezone being 0.05 to 5 g/l.

14. An image-forming method according to claim 12, wherein said developing solution contains, as a preservative, a sulfite.

15. An image-forming method according to claim 12, wherein said photographic material is processed at a pH of 9 to 12.

16. An image-forming method according to claim 12, wherein said development inhibitor is a compound selected from the group consisting of 5-nitroindazole, 6-nitroindazole, 5-methylbenzotriazole, 6-methylbenzotriazole, 5-nitrobenzoimidazole and 1-phenyl-5-mercaptotetrazole.

17. An image-forming method according to claim 12, wherein said development inhibitor is used in an amount of $10^{-1}$ to $10^{-5}$ mole per one liter of said developing solution.

18. An image-forming method according to claim 17, wherein said development inhibitor is used in an amount of $10^{-2}$ to $10^{-4}$ mole per one liter of said developing solution.

19. An image-forming method according to claim 12, wherein said development inhibitor is used after having been dissolved in an alkanolamine or a glycol and added to the developing solution.

* * * * *